US011927074B2

(12) United States Patent
Inglis et al.

(10) Patent No.: US 11,927,074 B2
(45) Date of Patent: Mar. 12, 2024

(54) LIQUID SPRING COMMUNICATION SUB

(71) Applicant: Halliburton Energy Services, Inc., Houston, TX (US)

(72) Inventors: Peter D. W. Inglis, Arbroath (GB); Katherine Davies, Arbroath (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/573,895

(22) Filed: Jan. 12, 2022

(65) Prior Publication Data

US 2023/0220746 A1 Jul. 13, 2023

(51) Int. Cl.
*E21B 34/10* (2006.01)
*E21B 23/00* (2006.01)
*E21B 23/04* (2006.01)

(52) U.S. Cl.
CPC ..... *E21B 34/102* (2013.01); *E21B 23/004* (2013.01); *E21B 23/0412* (2020.05)

(58) Field of Classification Search
CPC ..... E21B 23/004; E21B 23/02; E21B 23/04; E21B 23/0412; E21B 34/102
See application file for complete search history.

(56) References Cited

U.S. PATENT DOCUMENTS 6,223,824 B1 * 5/2001 Moyes ..... E21B 23/00 251/63.4
6,595,296 B1 * 7/2003 French ..... E21B 34/10 166/321
7,562,712 B2 * 7/2009 Cho ..... E21B 23/04 166/381
7,806,179 B2 * 10/2010 Coronado ..... E21B 23/04 166/242.7
7,861,788 B2 * 1/2011 Tips ..... E21B 43/2406 166/321
9,567,832 B2 * 2/2017 Hofman ..... E21B 34/103
9,915,122 B2 * 3/2018 Hofman ..... E21B 34/103
10,107,076 B2 * 10/2018 Muscroft ..... E21B 34/063
10,538,991 B2 * 1/2020 Hofman ..... E21B 33/13
11,359,457 B2 * 6/2022 Kent ..... E21B 43/12
11,428,071 B2 * 8/2022 Hiorth ..... E21B 34/063
(Continued)

FOREIGN PATENT DOCUMENTS

WO 2019226353 A1 11/2019

*Primary Examiner* — Jennifer H Gay
(74) *Attorney, Agent, or Firm* — Scott Richardson; Parker Justiss, P.C.

(57) ABSTRACT

Provided is a communications sub. The communications sub, in one aspect, includes a fluid chamber, and a pressure-activated indexing device positioned within the fluid chamber, the pressure-activated indexing device including a lock mandrel configured to incrementally move between an engaged state and a disengaged state when subjected to two or more pressure cycles. The communications sub, in accordance with one aspect, further includes a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state.

19 Claims, 14 Drawing Sheets

(56) References Cited

U.S. PATENT DOCUMENTS

| | | | | |
|---|---|---|---|---|
| 2005/0199399 | A1* | 9/2005 | Hayter | E21B 34/102 166/334.1 |
| 2005/0230122 | A1* | 10/2005 | Cho | E21B 23/04 166/381 |
| 2007/0007014 | A1 | 1/2007 | Sessions et al. | |
| 2008/0001111 | A1* | 1/2008 | Ross | E21B 23/04 166/332.1 |
| 2008/0302527 | A1* | 12/2008 | Coronado | E21B 23/06 166/321 |
| 2009/0014168 | A1* | 1/2009 | Tips | E21B 43/2406 166/73 |
| 2009/0218102 | A1* | 9/2009 | Casciaro | E21B 23/006 166/321 |
| 2012/0042966 | A1* | 2/2012 | Ross | E21B 34/103 137/517 |
| 2013/0161017 | A1 | 6/2013 | King | |
| 2014/0251636 | A1* | 9/2014 | Hofman | E21B 34/103 166/373 |
| 2015/0000920 | A1* | 1/2015 | Harris | E21B 34/14 166/305.1 |
| 2015/0129205 | A1* | 5/2015 | Hofman | E21B 34/103 166/250.01 |
| 2015/0233208 | A1* | 8/2015 | Muscroft | E21B 34/063 166/321 |
| 2016/0237785 | A1* | 8/2016 | Bacsik | E21B 34/14 |
| 2016/0258251 | A1 | 9/2016 | Hornsby | |
| 2017/0234091 | A1* | 8/2017 | Bisset | E21B 34/063 166/375 |
| 2018/0283130 | A1* | 10/2018 | Hofman | E21B 34/063 |
| 2020/0157916 | A1* | 5/2020 | Hofman | E21B 34/103 |
| 2021/0095543 | A1* | 4/2021 | Kent | E21B 34/10 |

* cited by examiner

LIQUID SPRING COMMUNICATION SUB

BACKGROUND

During wellbore operations, it may be important to activate one or more downhole devices. Typically, a downhole conveyance, such as wireline, slickline, coiled tubing, etc. is run within the wellbore to activate the one or more downhole devices. Unfortunately, this requires an additional trip downhole.

BRIEF DESCRIPTION

Reference is now made to the following descriptions taken in conjunction with the accompanying drawings, in which.

DETAILED DESCRIPTION

Figure 1:
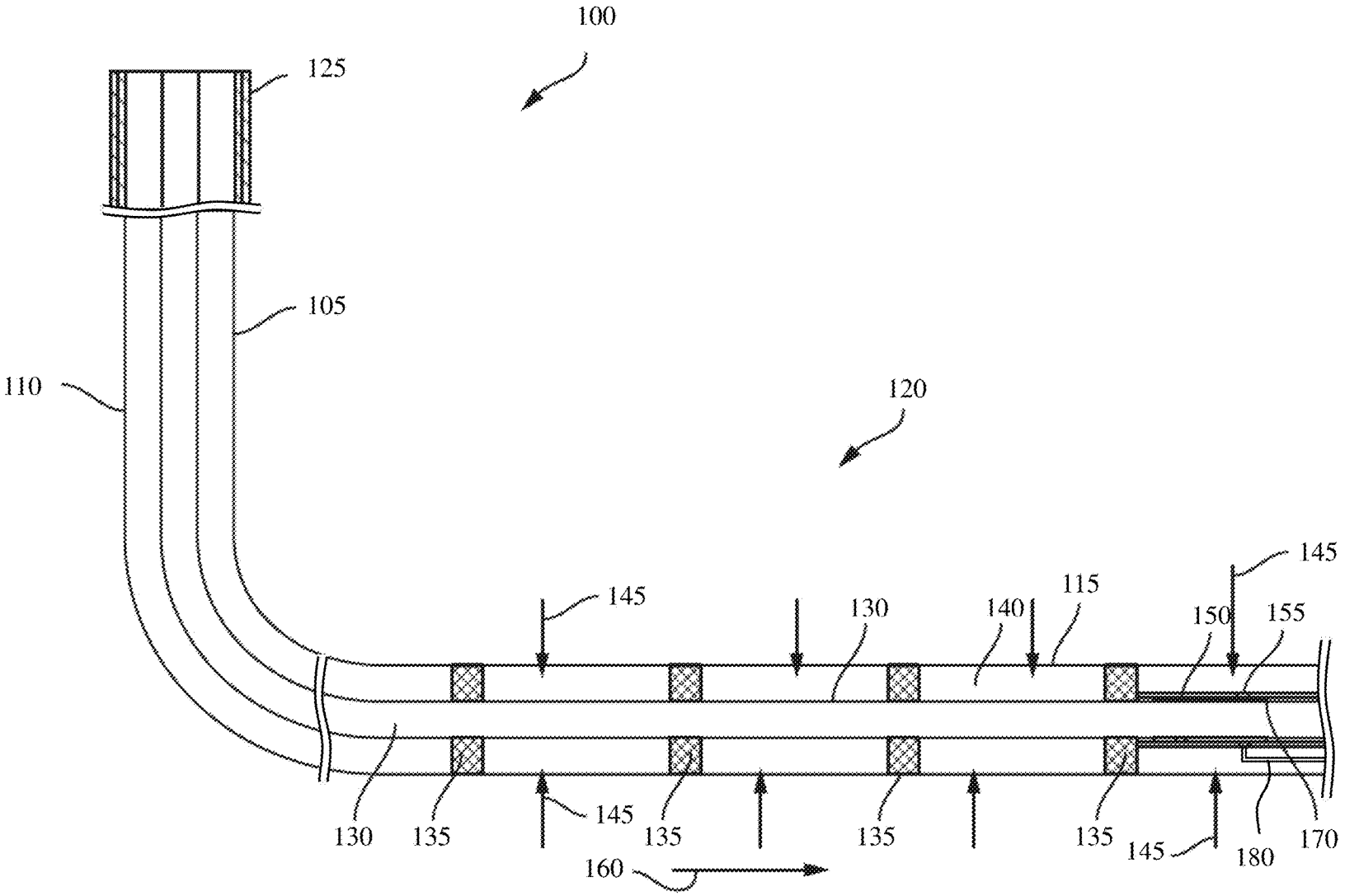
FIG. 1 is a cross-section schematic view of an example of a well system including a communications sub according to some aspects of the present disclosure.

Certain aspects and features relate to a communications sub for use in a well system. The communications sub, which in one embodiment may be a liquid spring communications sub, can be remotely opened by applying pressure cycles to a tubing string within a well. The communications sub can include a latch body (e.g., a sleeve including a collet configured to engage with a profile in an adjacent tubing in one embodiment) or other device that can be operated (e.g., linearly slid, rotated, etc.) to open a fluid path between the communications sub and another downhole device. The flow path, in certain embodiments, uses a fixed volume of fluid within the communications sub (e.g., a fixed volume of fluid within a low-pressure fluid chamber and a high-pressure fluid chamber of the communications sub) to activate the other downhole device. In certain embodiments, at least a portion of the opened flow path extends in an annulus between an outer housing (e.g., production tubing) and a wellbore.

Pressure cycles can be applied to the tubing string within the wellbore. After a predetermined number of pressure cycles have been applied to a pressure-activated indexing device, the pressure-activated indexing device can release and allow the latch body or other device to move to open the fluid path between the communications sub and the downhole device. When the latch body or other device is in a fixed position, the fixed latch body or other device closes the fluid path between the communications sub and the downhole device. However, when the latch body or other device is in a released position (e.g., the lock mandrel of the communications sub has de-supported the latch body), the released latch body or other device opens the fluid path between the communications sub and the downhole device.

The communications sub, in at least one embodiment, is a pressure cycle operated self-contained tool used to provide controlled communication to a variety of different equipment (specified hereafter as the downhole device). The communications sub permits fluid communication to any downhole device after the application of a predetermined number of pressure cycles. The operation of the communications sub, in at least one embodiment, is carried out by a ratchet mechanism that increments each time pressure is ramped up and/or bled down over a predetermined number of pressure cycles. When the predetermined number of pressure cycles has been applied, the communication sub is activated and/or opened, and fluid communication from the communications sub to a control line is permitted, thus allowing fluid within the communications sub (e.g., fluid within the low-pressure fluid chamber and high-pressure fluid chamber) to reach the downhole device.

In at least one embodiment, the communications sub employs a proven indexing system, for example using the low-pressure and high-pressure fluid chambers to generate a differential pressure, and an existing body lock ring system to ratchet through the required cycles. The pressure required to generate a cycle, in at least one embodiment, is determined by system friction and an indexing spring. The spring force is such that the minimum pressure required to compress the spring is set, which would be the non-cycle pressure. In at least one embodiment the minimum pressure required to compress the spring is typically over 1000 psi.

In at least one embodiment, wellbore pressure cycles above the non-cycle pressure ratchet the system, and after a pre-determined number of pressure cycles the lock mandrel is released from under the latch body, which allows the latch body to move (e.g., slide downhole in one embodiment) and expose fluid within the high-pressure fluid chamber to a control line port which is connected to a control line coupled to the downhole device. In at least one other embodiment, the latch body includes a collet, which may engage with a profile in an outer housing when the lock mandrel is in place, and a seal member configured to seal against the outer housing. In accordance with this embodiment, when the collet of the latch body is engaged with the profile in the outer housing, the seal member seals fluid in the high-pressure fluid chamber from the control line port, control line and the downhole device. However, when the lock mandrel is removed from under the latch body (e.g., after a pre-determined number of pressure cycles), the collet of the latch body is allowed to disengage from the profile in the outer housing, thereby allowing the latch body to move such that the seal member no longer seals the fluid in the high-pressure fluid chamber from the control line port, control line and the downhole device. Accordingly, in at least one embodiment the movement of the latch body and movement of the seal member allows the fluid within the high-pressure fluid chamber to travel through the control line and activate the downhole device.

Ultimately, the communications sub can limit occurrences of manual intervention to operate other downhole devices. Reducing the number of manual interventions in a wellbore drilling process and operation can reduce the nonprofit times and improve overall system efficiency.

The communications sub, in at least one embodiment, has two modes of operation: pre-remote-open and remote-open. In a pre-remote-open configuration, the communications sub is in a closed positioned, but in certain embodiments can be manually manipulated opened. For example, a profile on the lock mandrel and/or latch body can be used to manually open the latch body. In at least one embodiment, the latch body can be manually manipulated by a slickline tool string, or other downhole conveyance. In the closed position, fluid within the high-pressure fluid chamber is isolated from the control line to the downhole device. In the manually manipulated opened position, fluid within the high-pressure fluid chamber is exposed to the downhole device via the control line.

The communications sub can be transitioned from the pre-remote-open configuration to the remote-open configuration when a pre-determined number of pressure cycles are applied to the tubing string. Application of the predetermined number of pressure cycles to the system can result in the indexing of the system (e.g., similar to operation of a fluid loss isolation valve, or another type of valve). Upon the bleed down of the last pressure cycle, and thus removal of the lock mandrel from under the latch body, the collet of the latch body may be released, allowing the latch body to move to expose the fluid within the high-pressure fluid chamber to the downhole device via the control line. In at least one embodiment, fluid pressure within the high-pressure fluid chamber provides the necessary force required to move the latch body. In yet another embodiment, a spring member (e.g., mechanical spring member) may be used to push or pull the latch body and thereby move the latch body to expose the fluid within the high-pressure fluid chamber to the downhole device via the control line. In yet another embodiment, both fluid pressure and a spring member are used to move the latch body.

FIG. 1 is a cross-section schematic view of an example of a well system 100 including a communications sub 170 according to some aspects of the present disclosure. The well system 100 may include a wellbore 105 with a generally vertical section 110 that transitions into a generally horizontal section 115 extending through a subterranean earth formation 120. In an example, the vertical section 110 may extend in a downhole direction 160 from a portion of the wellbore 105 having a cemented casing string 125. A tubing string, such as a production tubing 130, may be installed or extended into the wellbore 105.

One or more packers 135 may be installed around the production tubing 130 within the wellbore 105. The packer 135 may seal an annulus 140 located between the production tubing 130 and walls of the wellbore 105 to create multiple intervals within the wellbore 105 for fluid production. As a result, fluids 145 may be produced from multiple intervals or "pay zones" of the formation 120 through isolated portions of the annulus 140 between adjacent pairs of packers 135.

In addition, the well system 100 may include the communications sub 170 that allows a latch body 150 to slide to close and/or expose one or more openings 155 in the communications sub 170. Accordingly, the latch body 150 may be actuated to expose fluid within the communications sub 170 (e.g., a high-pressure fluid chamber of the communications sub) to a control line 180 coupled to another downhole device (not shown). In one example, the communications sub 170 can be opened downhole without manual intervention.

In some examples, the communications sub 170 is a pressure-operated downhole device including an indexing mechanism that does not implement cams. The communications sub 170 can be a pressure-activated indexing device including a latch body that can be transitioned to an open configuration through the application of pressure cycles. Coupling the indexing section of a device with remote-open capability with a latch body enables a communication between the communications sub 170, a control line, and ultimately another downhole device upon demand (e.g., after a predetermined number of pressure cycles).

Figure 2A:
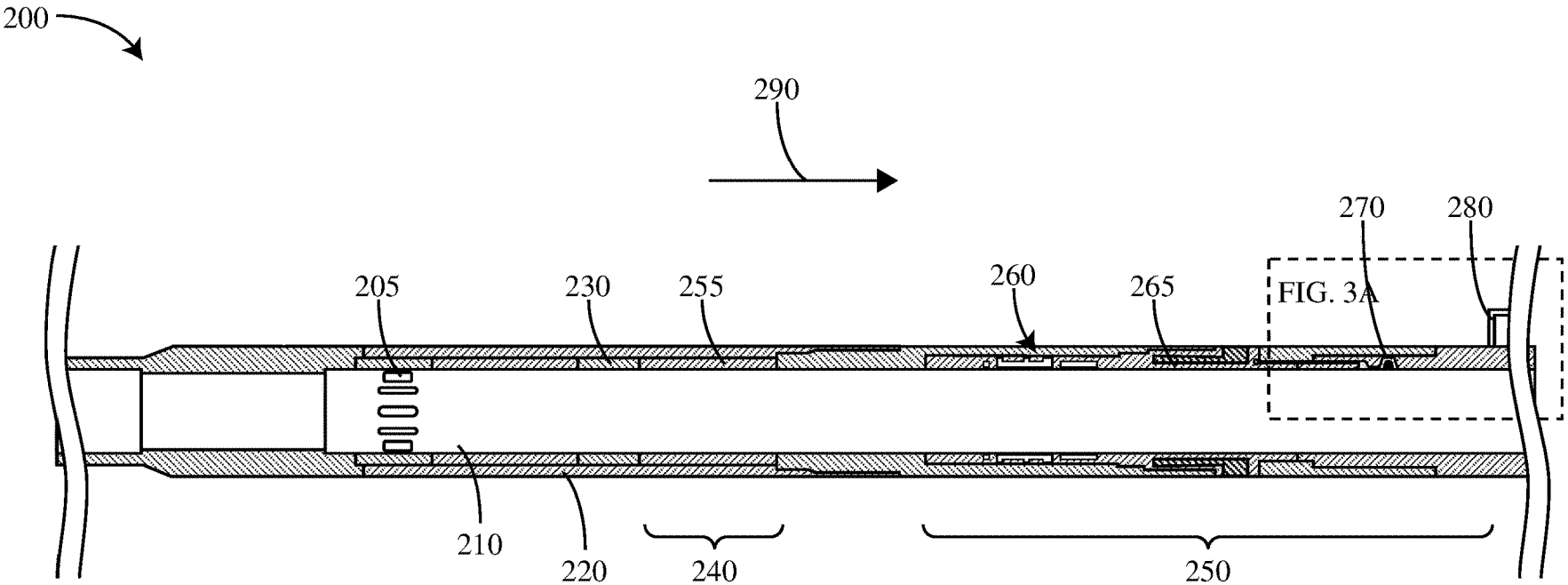
FIGS. 2A and 2B are sectional view of a communications sub designed, manufacture and/or operated according to one or more embodiments of the disclosure, at different operational stages.

FIG. 2A is a sectional view of the communications sub 200 designed, manufacture and/or operated according to one or more embodiments of the disclosure. The communications sub 200 may be similar in certain respects to the communications sub 170 illustrated in FIG. 1, and thus is suitable for a well system. The communications sub 200, in the illustrated embodiment, includes an inner tubing string 210 and an outer housing 220. Located within an annulus between the inner tubing string 210 and the housing 220 is a floating piston 230. The communications sub 200, in the illustrated embodiment, further includes a fluid chamber, which in one embodiment includes a low-pressure fluid chamber 240 and a high-pressure fluid chamber 250 (e.g., downhole of the floating piston 230).

In the illustrated embodiment, a fixed volume of fluid 255, is located within the low-pressure fluid chamber 240 and the high-pressure fluid chamber 250. By creating pressure cycles within the tubing string 210 (e.g., using a pressure pump located at a surface of the well system and wellbore fluid in the tubing string 210), the floating piston 230 can be used to deliver hydraulic pressure cycles to the fluid 255. When a pressure cycle is initiated in the tubing string 210, pressure from wellbore fluid supplied through one or more ports 205 in the tubing string 210 is transmitted to a side of the floating piston 230 opposite the fluid 255, thereby as least partially compressing the fluid 255 within the low-pressure fluid chamber 240 and/or the high-pressure fluid chamber 250. As pressure is applied to the floating piston 230, at least a portion of the fluid 255 transfers from the low-pressure fluid chamber 240 to the high-pressure fluid chamber 250, thereby substantially equalizing a fluid pressure of the fluid 255 in the low-pressure fluid chamber 240 and the high-pressure fluid chamber 250. When pressure from the wellbore fluid is removed from the floating piston 230, a restrictor positioned between the low-pressure fluid chamber 240 and the high-pressure fluid chamber 250 holds the high-pressure fluid chamber 250 at a higher pressure than the low-pressure fluid chamber 240 for a period of time. When the pressure substantially equalizes across the low-pressure fluid chamber 240 and the high-pressure fluid chamber 250, a single pressure cycle has completed.

The fluid 255 can be compressed silicone oil, and in one embodiment generates pressure in the downhole direction 290 against a pressure-activated indexing device 260. In at least one embodiment, the pressure-activated indexing device 260 includes an indexing piston that is coupled to a lock mandrel 265, such that each time indexing piston shifts from the first position to the second position, indexing piston pulls the lock mandrel 265 through one or more lock rings to shift the lock mandrel 265 by an increment (e.g., to the left in this embodiment). Moreover, the lock rings are configured such that when indexing piston shifts from the second position back to the first position, one or more of lock rings prevent the lock mandrel 265 from shifting back to its previous position (e.g., back to the right in this embodiment). Moreover, in at least one embodiment, the lock mandrel 265 moves an additional increment to the left after each pressure cycle described herein, where a threshold pressure or pressure differential is applied to indexing piston for a threshold period of time per cycle. In the embodiment of FIG. 2A, the lock mandrel 265 is coupled to a latch body 270. Further, applying a threshold number of pressure cycles (e.g., one cycle, two cycles, five cycles, or a different number of cycles of threshold pressure or pressure differential) to indexing piston shifts the latch mandrel 265 by the threshold number of increments to disengage with the latch body 270.

After a predetermined number of pressure cycles, the pressure-activated indexing device 260 (e.g., by way of moving a lock mandrel 265 of the pressure-activated indexing device 260) releases the latch body 270. In at least one embodiment, the lock mandrel 265 releases the latch body 270 by de-supporting it. With the latch body 270 released and free to move, fluid pressure within the high-pressure fluid chamber 250, a spring member inside or outside of the high-pressure fluid chamber 250, or a combination of both fluid pressure and a spring member, causes the latch body 270 to move (e.g., downhole in one embodiment). The movement of the latch body 270, in one or more embodiments, provides an open fluid path between the fluid 255 within the high-pressure fluid chamber 250 and a control line 280 coupled to another downhole device. Accordingly, a direct fluid path is provided from the communications sub 200 to the control line 280, and thus the fluid 255 may be used to activate another downhole device. The sectional view in FIG. 2A shows the communications sub 200 in a closed configuration, such that the fluid 255 within the communications sub 200 is isolated from the control line 280, and thus the downhole device.

Figure 2B:
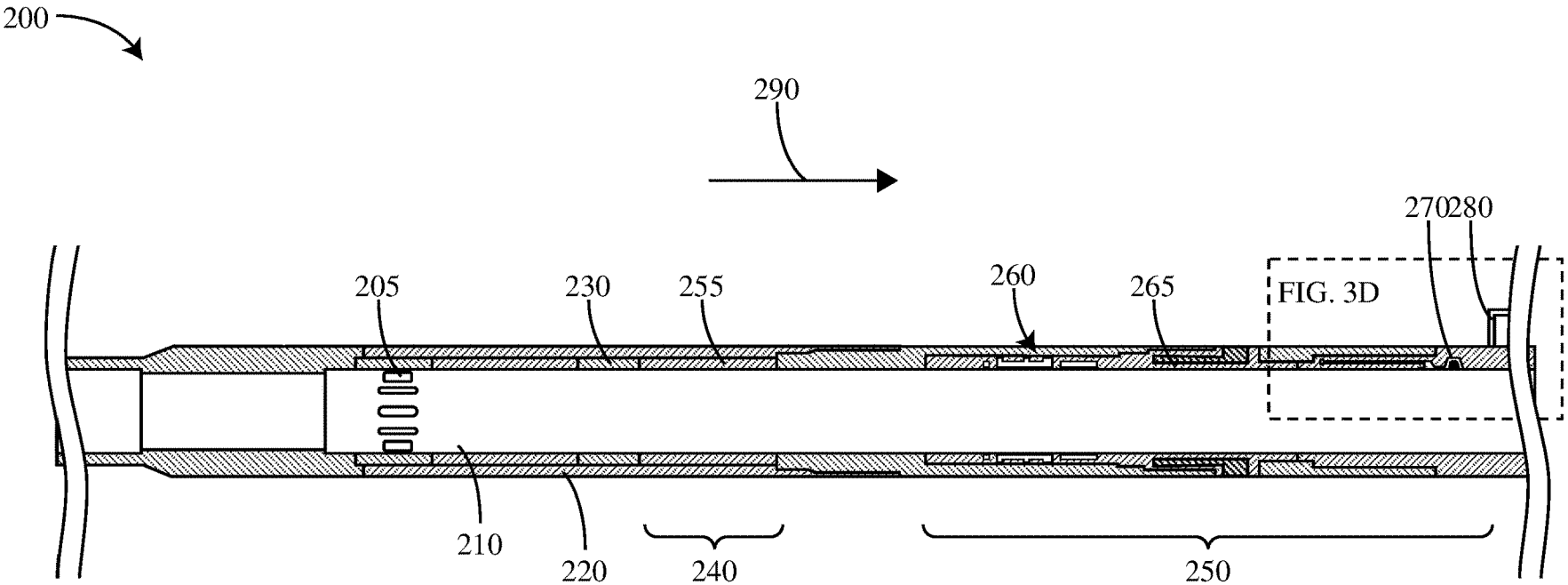

Turning briefly to FIG. 2B, illustrated is the communications sub 200 of FIG. 2A in the open configuration. For example, a sufficient number of pressure cycles has been applied to the pressure-activated indexing device 260, such that the lock mandrel 265 allows the latch body 270 to release and slide (e.g., downhole in the embodiment of FIG. 2B). Thus, the fluid 255 in the high-pressure fluid chamber 250 has access to the control line 280, and thus the downhole device.

Figure 3A:
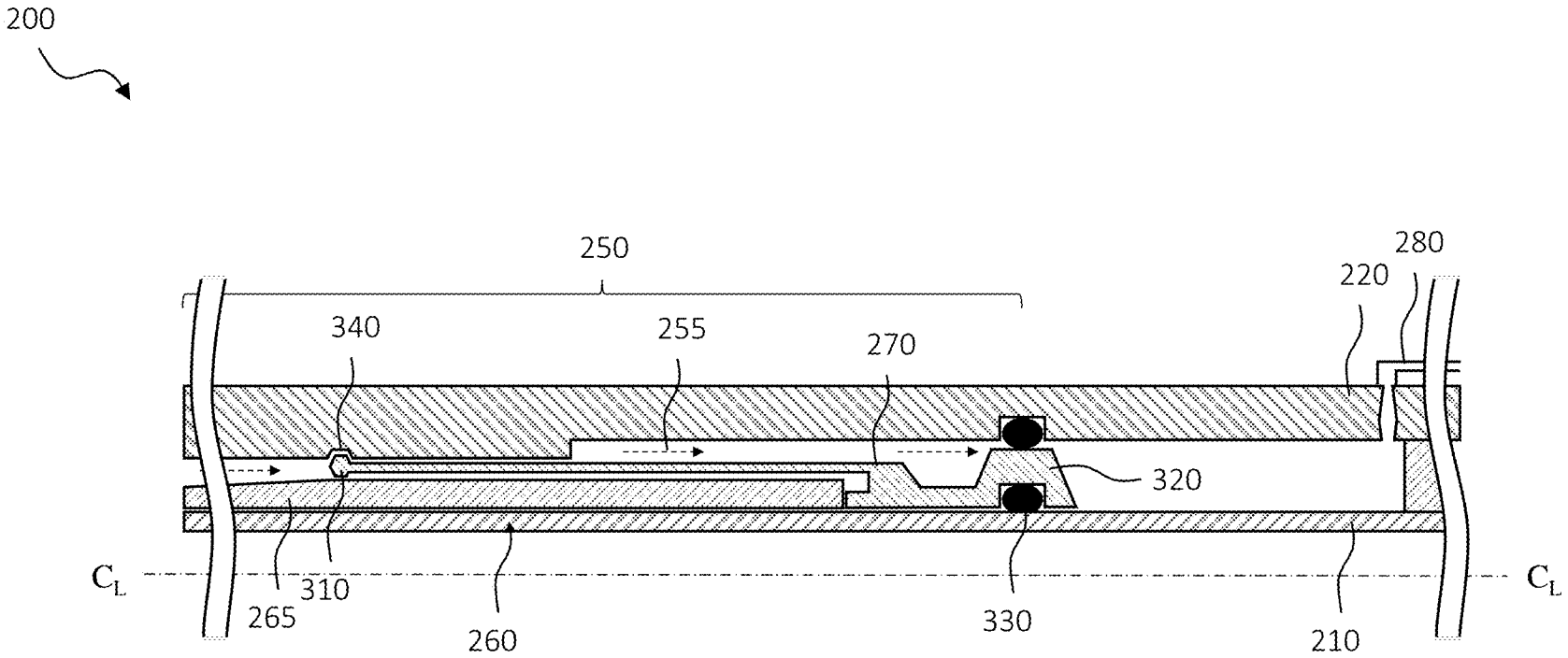
FIGS. 3A through 3E illustrate various different operational stages of at least a portion of the communications sub illustrated in FIGS. 2A and 2B.
Figure 3B:
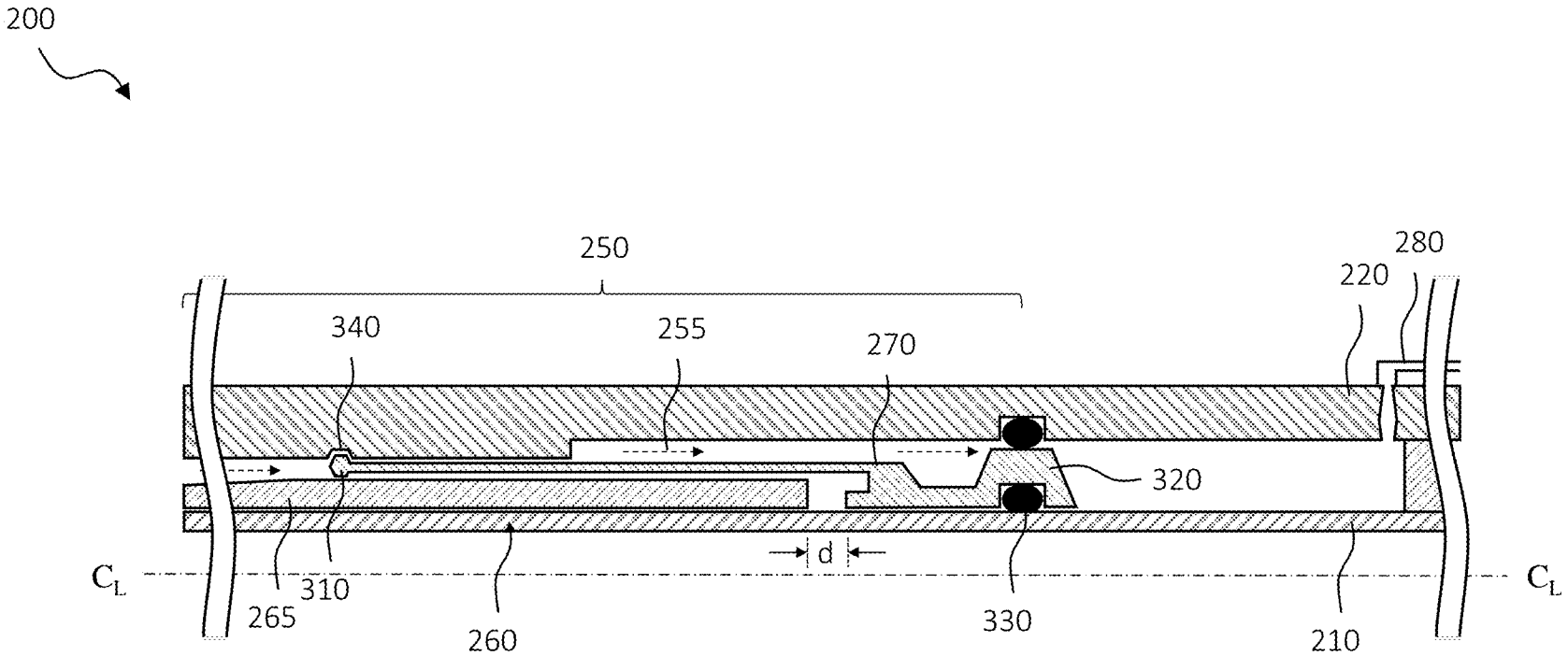
Figure 3C:
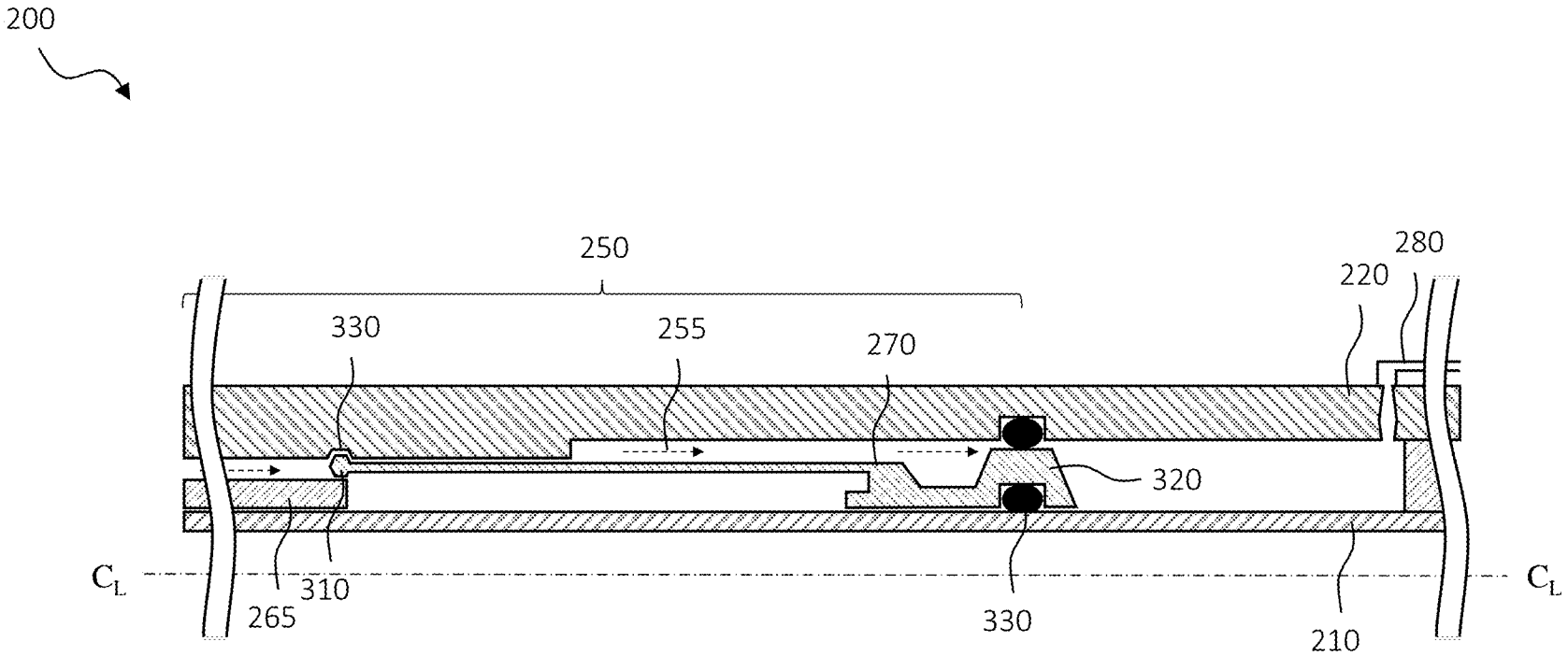
Figure 3D:
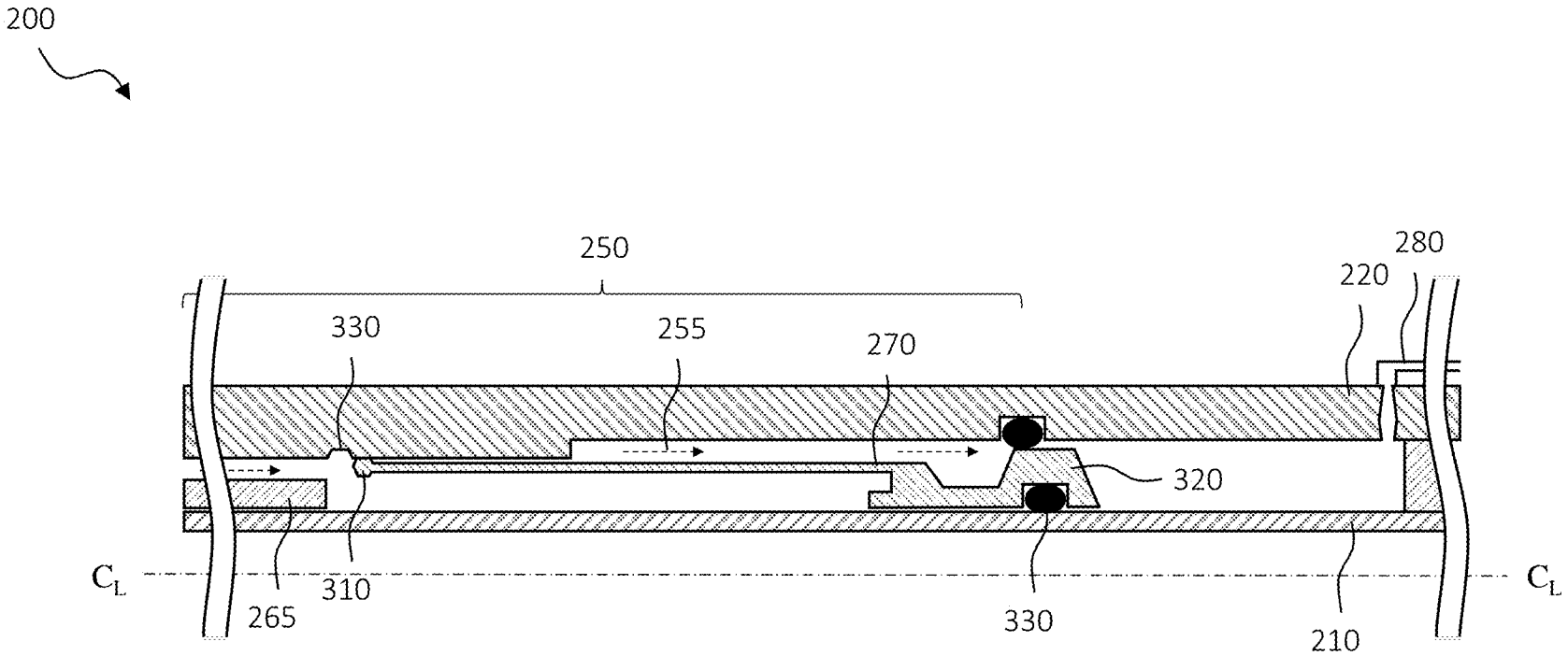
Figure 3E:
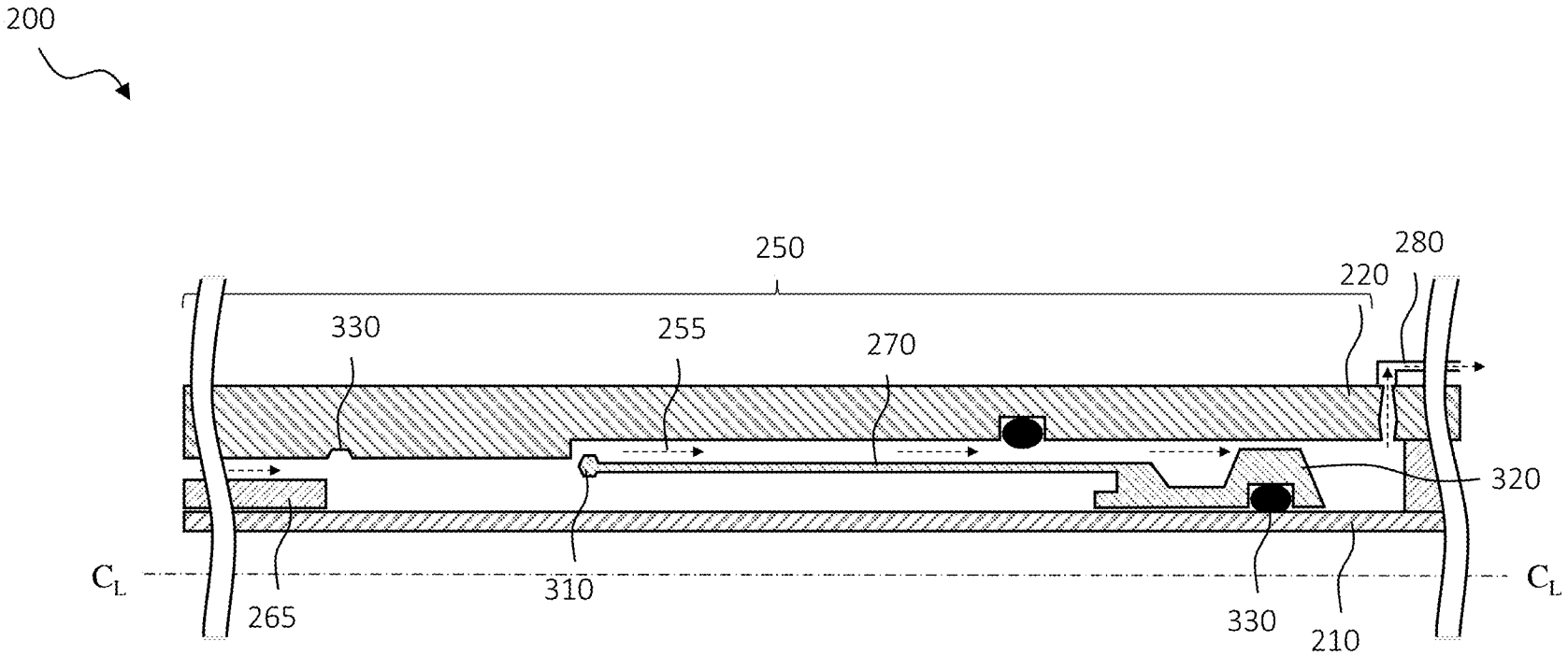

Turning now to FIGS. 3A through 3E, illustrated are various different operational stages of at least a portion of the communications sub 200 illustrated in FIGS. 2A and 2B. For instance, FIG. 3A illustrates a zoomed in view of the dotted box of FIG. 2A, whereas FIG. 3E illustrates a zoomed in view of the dotted box of FIG. 2B. In contrast, FIGS. 3B, 3C and 3D illustrate zoomed in views of the communications sub 200 at operational stages between that shown in FIG. 3A and FIG. 3E.

With initial reference to FIG. 3A, the communications sub 200 is in a closed position. Accordingly, the fluid 255 within the high-pressure fluid chamber 250 is isolated from the control line control line 280, and thus ultimately the downhole device. As shown, the lock mandrel 265 (e.g., which forms a part of or is at least coupled to the pressure-activated indexing device 260) is in an engages state that supports the latch body 270. For example, the lock mandrel 265 supports the latch body 270 such that a collet 310 of the latch body 270 is held in engagement with a related profile 340 in the outer housing 220. Accordingly, the latch body 270 is prevented from moving (e.g., laterally sliding and/or rotating). With the latch body 270 held in place, a seal member 320 of the latch body 270 engages with one or more seals 330 (e.g., O-rings in one embodiment) to isolate the fluid 255 from the control line 280. While the illustrated embodiment shows the latch body 270 and the seal member 320 as a single integral piece, other embodiments exist wherein they are two or more separate pieces. Ultimately, the latch body 270 just need to be capable of pushing the seal member 320 to release the one or more seals 330. In the illustrated embodiment, the fluid 255 on the uphole side of the seal member 320 and one or more seals 330 is at a higher pressure than any fluid on the downhole side of the seal member and one or more seals 330.

Turning to FIG. 3B, illustrated is the communications sub 200 of FIG. 3A after applying a first pressure cycle to the communications sub 200. As shown, with each pressure cycle, the lock mandrel 265 incrementally moves a predetermined distance (d). This predetermined distance (d) is, in certain embodiments, synonymous with the stroke distance of the pressure-activated indexing device 260. Again, at this stage the latch body 270 is still supported by the lock mandrel 265, and thus the seal member 320 and one or more seals 330 continue to isolate the fluid 255 from the control line 280.

Turning to FIG. 3C, illustrated is the communications sub 200 of FIG. 3B after applying a plurality of pressure cycles to the communications sub 200. With each pressure cycle, the lock mandrel 265 continues to move the predetermined distance (d). In the embodiment of FIG. 3C, the lock mandrel 265 is such that it will de-support the latch body 270 after the next pressure cycle. Again, at this stage the latch body 270 is still supported by the lock mandrel 265, and thus the seal member 320 and one or more seals 330 continue to isolate the fluid 255 from the control line 280.

Turning to FIG. 3D, illustrated is the communications sub 200 of FIG. 3C immediately after applying a final pressure cycle to the communications sub 200. As shown, the final pressure cycle withdraws the lock mandrel 265 from beneath the latch body 270. Accordingly, the lock mandrel 265 is in the disengaged state that no longer supports the latch body 270, and thus the collet 310 is allowed to disengage from the profile 340 in the outer housing 220. With the collet 310 disengaged from the profile 340 in the outer housing 220, the fluid pressure of the fluid 255 begins to move the latch body 270. In at least one embodiment, the fluid pressure of the fluid 255 begins to linearly slide the latch body 270. In at least one other embodiment, the fluid pressure of the fluid 255 begins to rotate the latch body 270. For at least a moment, the seal member 320 and one or more seals 330 continue to isolate the fluid 255 from the control line 280.

Turning to FIG. 3E, illustrated is the communications sub 200 of FIG. 3D after the fluid pressure of the fluid 255 continues to act upon the seal member 320 and one or more seals 330, at least until the latch body 270 moves far enough that the seal member 320 and one or more seals 330 no longer isolate the fluid 255 from the control line 280. With the seal member 320 and the one or more seals 330 no longer isolating the fluid 255 from the control line 280, the fluid 255 may travel to another downhole device for activation thereof.

In at least one embodiment, it is important that the volume of the low-pressure fluid chamber and the high-pressure fluid chamber be sufficient to, once the fluid 255 is no longer isolated from the control line 280, allow the fluid to activate the one or more downhole devices. For example, in at least one embodiment, a volume of the fluid 255 in the low-pressure fluid chamber and the high-pressure fluid chamber would need to be sufficient to fully fill the control line 280 and have the ability to activate the one or more downhole devices. In yet another embodiment, the control line is already full of fluid, but a volume of the fluid 255 in the low-pressure fluid chamber and the high-pressure fluid chamber would need to be sufficient that it had enough retained pressure once the fluid path is opened to activate the one or more downhole devices. In at least one embodiment, the volume of the low-pressure fluid chamber and the high-pressure fluid chamber is at least 1 liter. In yet another embodiment, the volume of the low-pressure fluid chamber and the high-pressure fluid chamber is at least 5 liters, and in yet even another embodiment the volume of the low-pressure fluid chamber and the high-pressure fluid chamber is at least 10 liters, and in even yet another embodiment the volume of the low-pressure fluid chamber and the high-pressure fluid chamber is at least 15 liters.

Figure 4A:
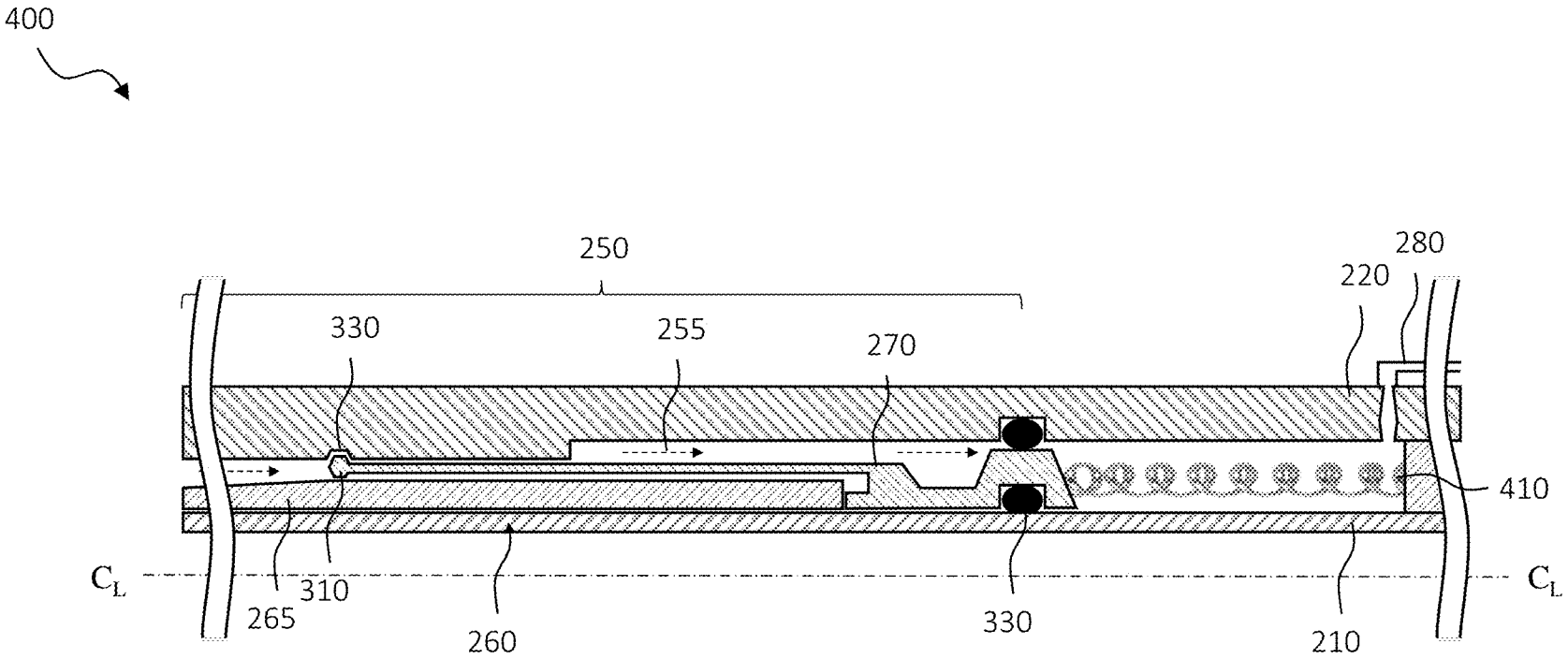
FIGS. 4A through 4E illustrate various different operational stages of at least a portion of an alternative embodiment of the communications sub illustrated in FIGS. 2A and 2B.
Figure 4B:
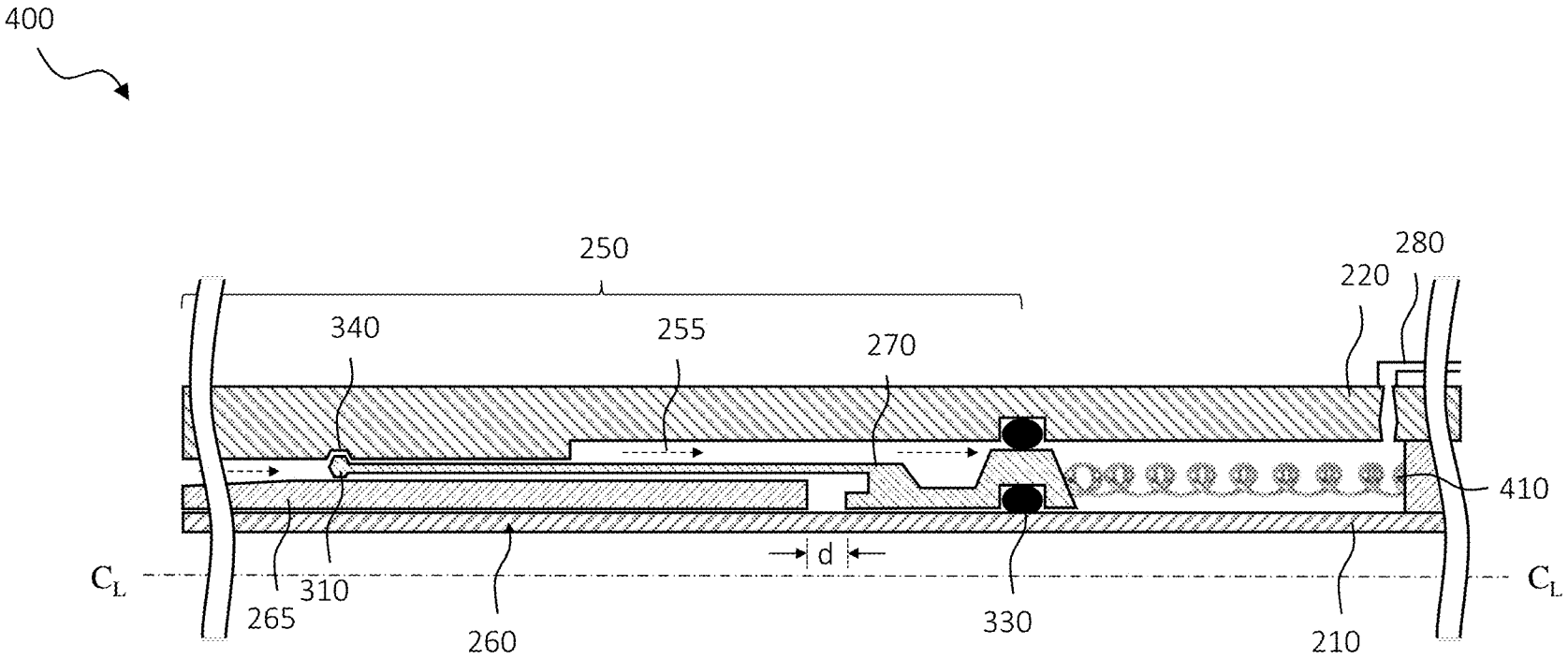
Figure 4C:
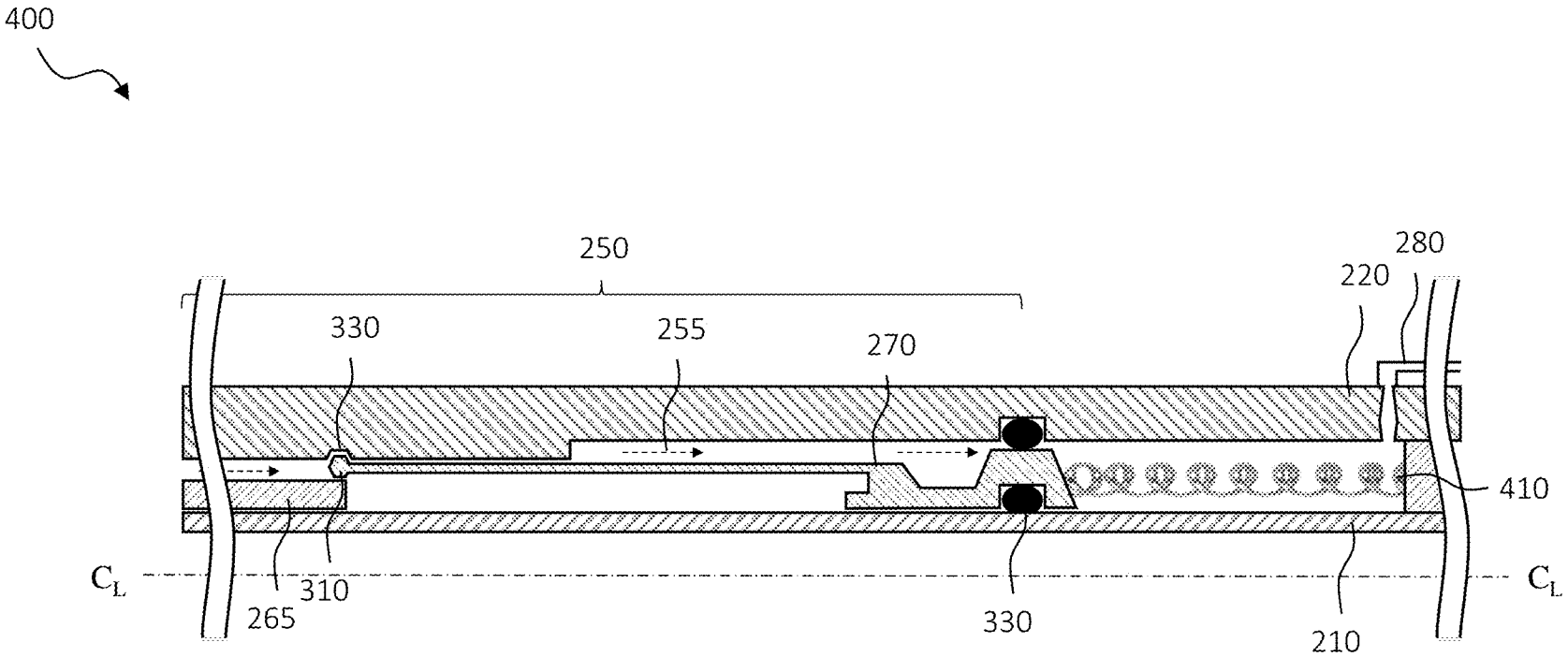
Figure 4D:
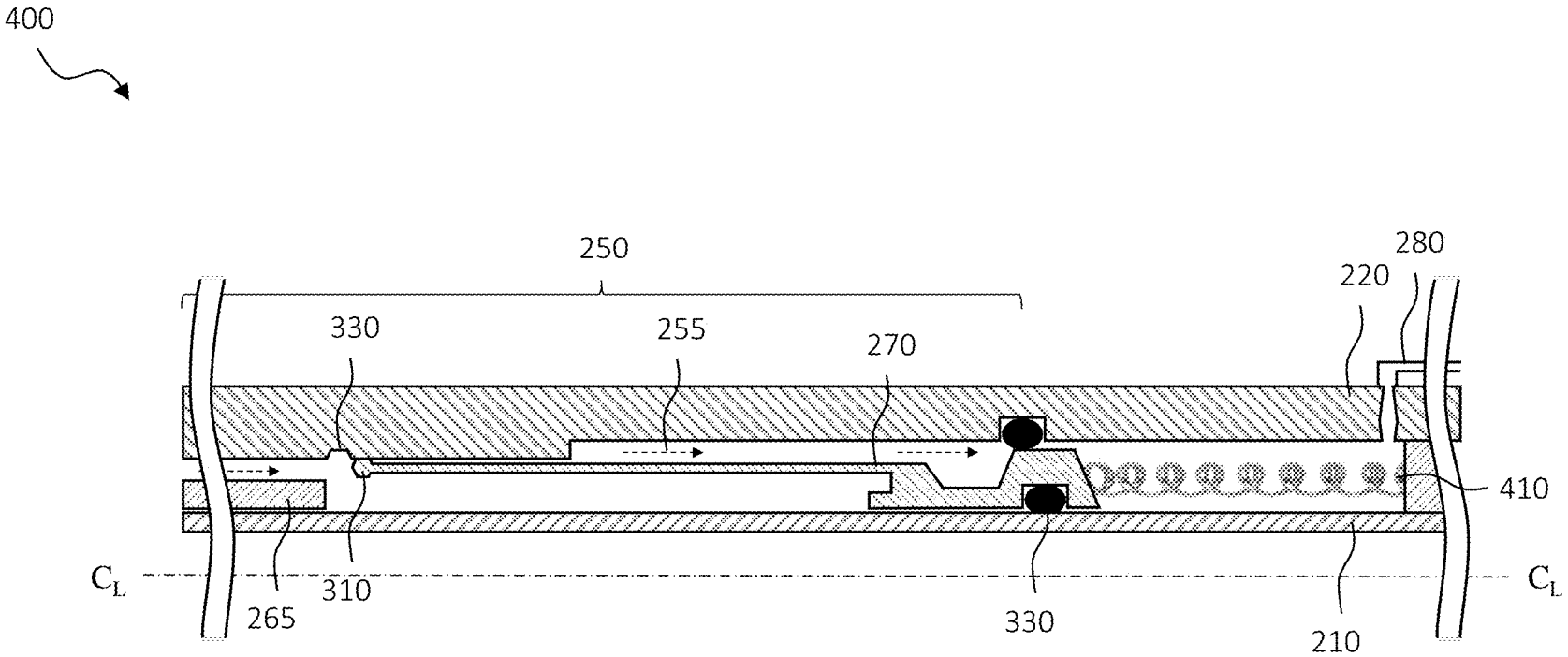
Figure 4E:
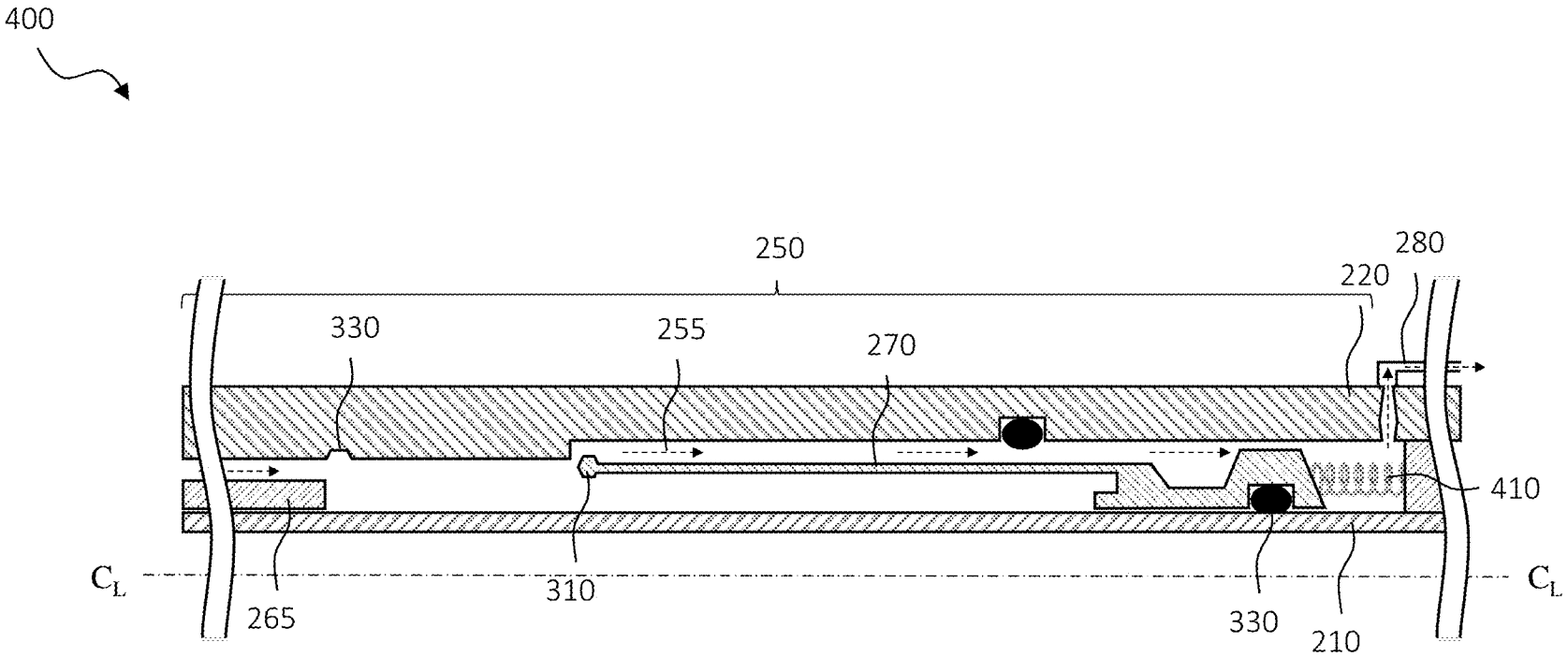

Turning now to FIGS. 4A through 3E, illustrated are various different operational stages of at least a portion of the communications sub 400 designed, manufactured and operated according to one or more embodiments of the disclosure. The communication sub 400 of FIGS. 4A through 4E is similar in many respects to the communications sub 200 of FIGS. 3A through 3E. Accordingly, like reference numbers have been used to illustrate similar, if not identical, features. The communications sub 400 differs, for the most part, from the communications sub 200 in that the communications sub 400 includes a spring member 410 (e.g., a mechanical spring member) that moves the latch body 270 from the closed state to the opened state. In the illustrated embodiment, the spring member 410 pulls the latch body 270 from the closed state to the open state when the latch body 270 is no longer supported by the lock mandrel 265. In an alternative embodiment, the spring member 410 could push the latch body 270 from the closed state to the open state when the latch body 270 is no longer supported by the lock mandrel 265. In the illustrated embodiment, fluid pressure from the fluid 255 assists moving the latch body 270 from the closed state to the open state when the latch body 270 is no longer supported by the lock mandrel 265.

Figure 5:
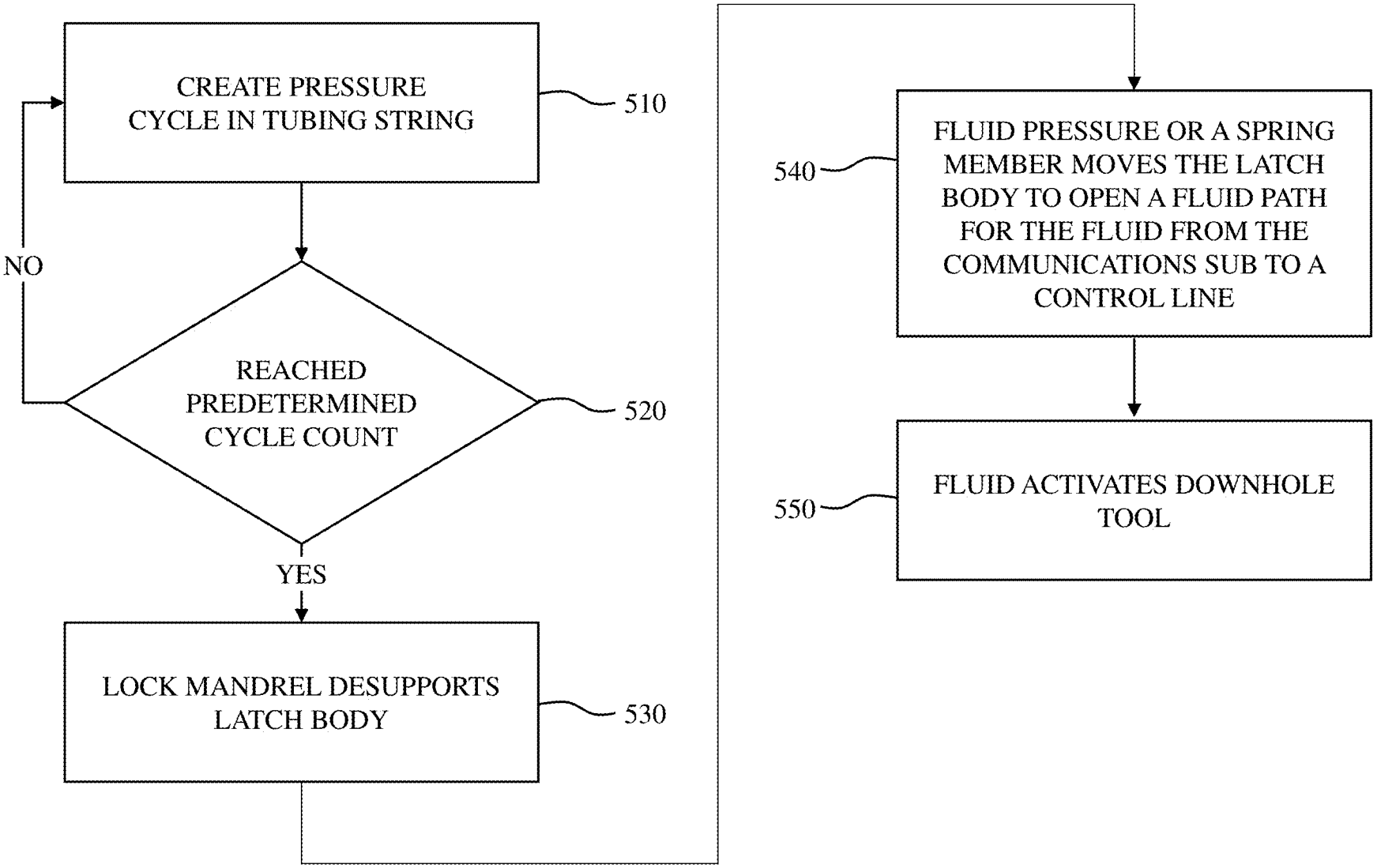
FIG. 5 illustrates a flowchart of a process for operating a communications sub according to some aspects of the present disclosure.

Turning to FIG. 5, illustrated is a flowchart of a process 500 for operating a communications sub according to some aspects of the present disclosure. The communications sub may be similar in one or more respects to the communications sub described above with regard to FIGS. 2A through 4E, among other communications subs consistent with the disclosure. The process begins with the communications sub in the closed position, for example such that the lock mandrel and latch body collectively prevent the fluid within the high-pressure fluid chamber of the communications sub from access to the control line, and thus ultimately the downhole device. At block 510, the process 500 involves creating a pressure cycle in the tubing string. Once the pressure cycle is created, the floating piston of the communications sub delivers one or more pressure cycles to the pressure-activated indexing device. At block 520, the pressure-activated indexing device moves according to the number of pressure cycles that have been applied. For example, in one or more embodiments the lock mandrel will move the distance (d) for each pressure cycle. If the number of pressure cycles is less than a predetermined number of pressure cycles, no further action is taken until more pressure cycles are applied, as shown in block 510.

At block 530, after a predetermined number of pressure cycles, the process 500 involves the lock mandrel of the pressure-activated indexing device de-supporting the latch body, thereby allowing the latch body to move (e.g., slide linearly or rotate). At 540, the process 500 involves the latch body moving to open a fluid path for the fluid from the communications sub (e.g., the fluid located in the high-pressure fluid chamber) to the control line. Prior to this step, the latch body and lock mandrel collectively closed this fluid path. At block 550, the open fluid path and the fluid from the communications sub (e.g., fluid located in the high-pressure fluid chamber) activate a downhole device (e.g., separate downhole device).

Examples of the methods disclosed in the process in FIG. 5 may be performed in the operation of the communications sub as shown in FIGS. 2 through 4E, among other communications subs5 The order of the blocks presented in the process in FIG. 5 above can be varied—for example, blocks can be reordered, combined, removed, broken into sub-blocks, or any combination thereof. Certain blocks or processes can also be performed in parallel.

Aspects disclosed herein include:

A. A communications sub, the communications sub including: 1) a fluid chamber; 2) a pressure-activated indexing device positioned within the fluid chamber, the pressure-activated indexing device including a lock mandrel configured to incrementally move between an engaged state and a disengaged state when subjected to two or more pressure cycles; and 3) a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state.

B. A method for activating a downhole device, the method including: 1) providing a communications sub, the communications sub including: a) a fluid chamber; b) a pressure-activated indexing device positioned within the fluid chamber, the pressure-activated indexing device including a lock mandrel configured to incrementally move between an engaged state and a disengaged state; and c) a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state; and 2) subjecting the pressure-activated indexing device to two or more pressure cycles to move the lock mandrel between the engaged state and the disengaged state and allow the latch body to move to open the fluid path between the fluid chamber and the control line coupled to a downhole device.

C. A well system, the well system including: 1) a wellbore located in a subterranean formation; 2) a tubing string located within the wellbore; 3) a communications sub coupled with the tubing string, the communications sub including: a) a fluid chamber; b) a pressure-activated indexing device positioned within the fluid chamber, the pressure-activated indexing device including a lock mandrel configured to incrementally move between an engaged state and a disengaged state when subjected to two or more pressure cycles; and c) a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state; and 4) a downhole device coupled to the control line.

Aspects A, B, and C may have one or more of the following additional elements in combination: Element 1: wherein the latch body includes a collet configured to engage with a profile in an outer housing to keep the latch body fixed in place when the lock mandrel is in the engaged state and configured to disengage from the profile to allow the lock mandrel to move when the lock mandrel is in the disengaged state. Element 2: wherein the latch body includes a seal member, the seal member configured to engage with one or more seals to close the fluid path from the fluid chamber to the control line when the latch body is fixed in place and open the fluid path from the fluid chamber to the control line when allowed to move. Element 3: wherein the lock mandrel radially supports the latch body when in the engaged state and radially de-supports the latch body when in the disengaged state. Element 4: further including a spring member coupled to the latch body, the spring member configured to move the latch body when the lock mandrel moves from the engaged state to the disengaged state. Element 5: further including an inner tubing string, an outer housing, and a floating piston located in an annulus between the inner tubing string and the outer housing, the floating piston defining the fluid chamber. Element 6: wherein the fluid chamber includes a fluid restrictor positioned therein, the fluid restrictor separating the fluid chamber into a low-pressure fluid chamber and a high-pressure fluid chamber. Element 7: wherein subjecting the pressure-activated indexing device to two or more pressure cycles opens the fluid path between the fluid chamber and the control line to activate the downhole device.

Those skilled in the art to which this application relates will appreciate that other and further additions, deletions, substitutions and modifications may be made to the described embodiments.

What is claimed is:

1. A communications sub, comprising:

a fluid chamber;

a pressure-activated indexing device positioned within the fluid chamber, the pressure-activated indexing device including a lock mandrel configured to incrementally move between an engaged state and a disengaged state when subjected to two or more pressure cycles; and a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state, wherein the lock mandrel radially supports the latch body when in the engaged state and radially de-supports the latch body when in the disengaged state.

2. The communications sub as recited in claim 1, wherein the latch body includes a collet configured to engage with a profile in an outer housing to keep the latch body fixed in place when the lock mandrel is in the engaged state and configured to disengage from the profile to allow the lock mandrel to move when the lock mandrel is in the disengaged state.

3. The communications sub as recited in claim 1, wherein the latch body includes a seal member, the seal member configured to engage with one or more seals to close the fluid path from the fluid chamber to the control line when the latch body is fixed in place and open the fluid path from the fluid chamber to the control line when allowed to move.

4. The communications sub as recited in claim 1, further including a spring member coupled to the latch body, the spring member configured to move the latch body when the lock mandrel moves from the engaged state to the disengaged state.

5. The communications sub as recited in claim 1, further including an inner tubing string, an outer housing, and a floating piston located in an annulus between the inner tubing string and the outer housing, the floating piston defining the fluid chamber.

6. The communications sub as recited in claim 5, wherein the fluid chamber includes a fluid restrictor positioned therein, the fluid restrictor separating the fluid chamber into a low-pressure fluid chamber and a high-pressure fluid chamber.

7. A method for activating a downhole device, comprising:

providing a communications sub, the communications sub including:

a fluid chamber;

a pressure-activated indexing device positioned within the fluid chamber, the pressure-activated indexing device including a lock mandrel configured to incrementally move between an engaged state and a disengaged state; and a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state, wherein the lock mandrel radially supports the latch body when in the engaged state and radially de-supports the latch body when in the disengaged state; and subjecting the pressure-activated indexing device to two or more pressure cycles to move the lock mandrel between the engaged state and the disengaged state and allow the latch body to move to open the fluid path between the fluid chamber and the control line coupled to a downhole device.

8. The method as recited in claim 7, wherein subjecting the pressure-activated indexing device to two or more pressure cycles opens the fluid path between the fluid chamber and the control line to activate the downhole device.

9. The method as recited in claim 7, wherein the latch body includes a collet configured to engage with a profile in an outer housing to keep the latch body fixed in place when the lock mandrel is in the engaged state and configured to disengage from the profile to allow the lock mandrel to move when the lock mandrel is in the disengaged state.

10. The method as recited in claim 7, wherein the latch body includes a seal member, the seal member configured to engage with one or more seals to close the fluid path from the fluid chamber to the control line when the latch body is fixed in place and open the fluid path from the fluid chamber to the control line when allowed to move.

11. The method as recited in claim 7, further including a spring member coupled to the latch body, the spring member configured to move the latch body when the lock mandrel moves from the engaged state to the disengaged state.

12. The method as recited in claim 7, further including an inner tubing string, an outer housing, and a floating piston located in an annulus between the inner tubing string and the outer housing, the floating piston defining the fluid chamber.

13. The method as recited in claim 12, wherein the fluid chamber includes a fluid restrictor positioned therein, the fluid restrictor separating the fluid chamber into a low-pressure fluid chamber and a high-pressure fluid chamber.

14. A well system, comprising:

a wellbore located in a subterranean formation;

a tubing string located within the wellbore;

a communications sub coupled with the tubing string, the communications sub including:

a fluid chamber;

a pressure-activated indexing device positioned within the fluid chamber, the pressure-activated indexing device including a lock mandrel configured to incrementally move between an engaged state and a disengaged state when subjected to two or more pressure cycles; and a latch body positioned in the fluid chamber, the latch body configured to be fixed in place by the lock mandrel and close a fluid path from the fluid chamber to a control line when the lock mandrel is in the engaged state, and configured to be allowed to move and open the fluid path from the fluid chamber to the control line when the lock mandrel is in the disengaged state, wherein the lock mandrel radially supports the latch body when in the engaged state and radially de-supports the latch body when in the disengaged state; and a downhole device coupled to the control line.

15. The well system as recited in claim 14, wherein the latch body includes a collet configured to engage with a profile in an outer housing to keep the latch body fixed in place when the lock mandrel is in the engaged state and configured to disengage from the profile to allow the lock mandrel to move when the lock mandrel is in the disengaged state.

16. The well system as recited in claim 14, wherein the latch body includes a seal member, the seal member configured to engage with one or more seals to close the fluid path from the fluid chamber to the control line when the latch body is fixed in place and open the fluid path from the fluid chamber to the control line when allowed to move.

17. The well system as recited in claim 14, further including a spring member coupled to the latch body, the spring member configured to move the latch body when the lock mandrel moves from the engaged state to the disengaged state.

18. The well system as recited in claim 14, further including an inner tubing string, an outer housing, and a floating piston located in an annulus between the inner tubing string and the outer housing, the floating piston defining the fluid chamber.

19. The well system as recited in claim 18, wherein the fluid chamber includes a fluid restrictor positioned therein, the fluid restrictor separating the fluid chamber into a low-pressure fluid chamber and a high-pressure fluid chamber.

* * * * *